US009670790B2

(12) United States Patent
Bergman et al.

(10) Patent No.: US 9,670,790 B2
(45) Date of Patent: Jun. 6, 2017

(54) TURBINE VANE WITH MISTAKE REDUCTION FEATURE

(71) Applicant: United Technologies Corporation, Hartford, CT (US)

(72) Inventors: Russell J. Bergman, Windsor, CT (US); Leonard A. Bach, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 1224 days.

(21) Appl. No.: 13/659,969

(22) Filed: Oct. 25, 2012

(65) Prior Publication Data

US 2014/0147263 A1 May 29, 2014

Related U.S. Application Data

(60) Provisional application No. 61/707,553, filed on Sep. 28, 2012.

(51) Int. Cl.
*F01D 9/02* (2006.01)
*F01D 9/04* (2006.01)

(52) U.S. Cl.
CPC ..... *F01D 9/042* (2013.01); *F05D 2230/60* (2013.01); *F05D 2230/64* (2013.01); *F05D 2240/12* (2013.01); *Y10T 29/49323* (2015.01)

(58) Field of Classification Search
CPC ..... F01D 9/042
USPC ..... 415/209.2; 29/889.22
See application file for complete search history.

(56) References Cited

U.S. PATENT DOCUMENTS

| | | | | |
|---|---|---|---|---|
| 6,325,593 | B1 | 12/2001 | Darkins, Jr. et al. | |
| 7,258,525 | B2 | 8/2007 | Boeck | |
| 7,296,615 | B2 * | 11/2007 | Devine et al. | 164/516 |
| 7,507,075 | B2 | 3/2009 | Kang et al. | |
| 8,047,778 | B2 | 11/2011 | Kasperski et al. | |
| 8,297,934 | B2 * | 10/2012 | Lutz et al. | 416/230 |
| 2002/0114701 | A1 | 8/2002 | Coulson | |
| 2007/0036656 | A1 * | 2/2007 | Kang | F01D 5/147 416/204 R |
| 2008/0041064 | A1 | 2/2008 | Moore et al. | |
| 2010/0098547 | A1 | 4/2010 | Hagen et al. | |
| 2010/0172752 | A1 * | 7/2010 | McGovern | F01D 9/041 415/208.1 |
| 2011/0097206 | A1 | 4/2011 | Belmonte et al. | |
| 2011/0206501 | A1 * | 8/2011 | Bergman | F01D 9/041 415/177 |
| 2011/0233876 | A1 * | 9/2011 | Bergman et al. | 277/628 |
| 2011/0236199 | A1 * | 9/2011 | Bergman et al. | 415/208.1 |

FOREIGN PATENT DOCUMENTS

EP 2025864 A2 2/2009

OTHER PUBLICATIONS

The International Search Report mailed Jan. 27, 2014 for International Application No. PCT/US2013/061121.

* cited by examiner

*Primary Examiner* — Richard Edgar
(74) *Attorney, Agent, or Firm* — Kinney & Lange, P.A.

(57) ABSTRACT

A turbine vane for a gas turbine engine has an inner platform, an outer platform, at least one airfoil extending between the inner and outer platforms, and a tab radially extending inward from a front side of the inner platform. The tab contains a mounting aperture and an identification aperture that identifies an engine in which the turbine vane may be installed.

9 Claims, 5 Drawing Sheets

TURBINE VANE WITH MISTAKE REDUCTION FEATURE

BACKGROUND

The present invention relates to turbine vanes for turbomachinery such as gas turbine engines, and more particularly, to identification features for the vanes on the platforms from which the airfoils extend.

Turbine vanes are mounted circumferentially between inner and outer diameter platforms, and are used to guide airflow to a downstream blade such that energy and work can be extracted from the airflow.

Engines of similar size contain similar vanes. There is a need to distinguish vanes among engines. Prior art gas turbine engines typically do not include any visual features to easily identify an engine model in which a component is to be installed. Consequently, mistakes can happen during assembly.

SUMMARY

In one embodiment, a turbine vane for a gas turbine engine has an inner platform, an outer platform, at least one airfoil extending between the inner and outer platforms, and a tab radially extending inward from a front side of the inner platform. The tab contains a mounting aperture and an identification aperture that identifies an engine in which the turbine vane may be installed.

In another embodiment, a method includes designing an engine including a component with an identification feature that identifies the engine, providing the component with the identification feature, and providing the engine design instructions during assembly of the engine so that the identification feature on the engine component is visually compared to the engine design instructions to assure the component is being installed in the correct engine.

In yet another embodiment, a method includes producing a turbine vane with a tab radially extending inward from a front side of an inner platform of the vane, and producing a visually identifiable feature on the tab that identifies the engine in which the turbine vane may be installed.

DETAILED DESCRIPTION

Figure 1:
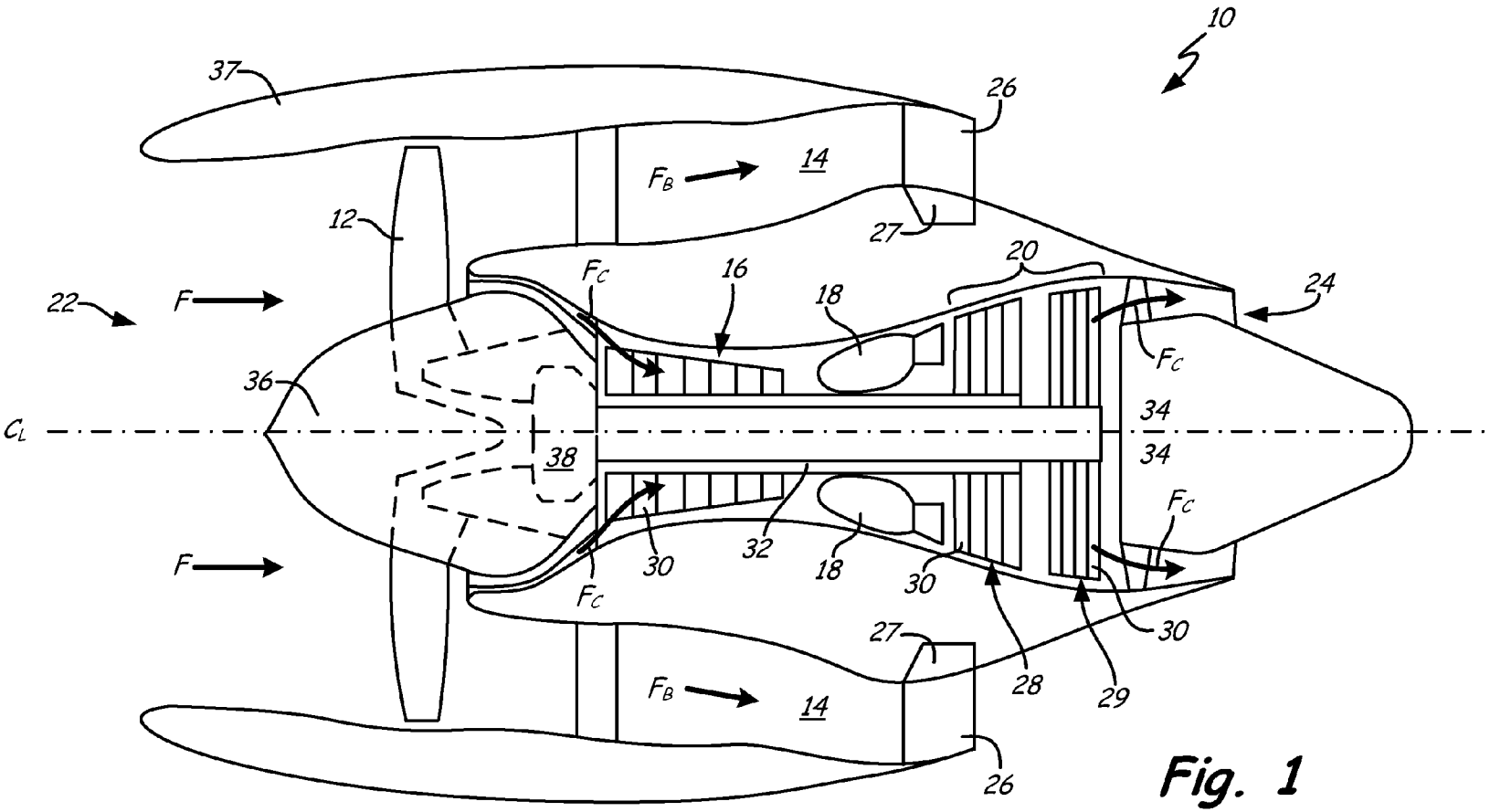
FIG. 1 is a cross-section a gas turbine engine.

FIG. 1 is a cross-sectional view of turbine engine 10, in a turbofan embodiment. Turbofan engine 10 comprises fan 12 with bypass duct 14 oriented about a turbine core comprising compressor 16, combustor 18 and turbine 20, which are arranged in flow series with upstream inlet 22 and downstream exhaust 24. Variable area nozzle 26 is positioned in bypass duct 14 in order to regulate bypass flow $F_B$ with respect to core flow FC, in response to adjustment by actuator(s) 27.

Turbine 20 comprises high-pressure (HPT) section 28 and low-pressure (LPT) section 29. Compressor 16 and turbine sections 28 and 29 each comprise a number of alternating turbine blades and turbine vanes 30. Turbine vanes 30 are circumferentially against one another, and collectively forming a full, annular ring about the centerline axis $C_L$ of the engine. HPT section 28 of turbine 20 is coupled to compressor 16 via HPT shaft 32, forming the high pressure spool. LPT section 29 is coupled to fan 12 via LPT shaft 34, forming the low pressure spool. LPT shaft 34 is coaxially mounted within HPT shaft 32, about turbine axis (centerline) $C_L$.

Fan 12 is typically mounted to a fan disk or other rotating member, which is driven by LPT shaft 34. As shown in FIG. 1, for example, fan 12 is forward-mounted in engine cowling 37, upstream of bypass duct 14 and compressor 16, with spinner 36 covering the fan disk to improve aerodynamic performance. Alternatively, fan 12 is aft-mounted in a downstream location, and the coupling configuration varies. Further, while FIG. 1 illustrates a particular two-spool high-bypass turbofan embodiment of turbine engine 10, this example is merely illustrative. In other embodiments turbine engine 10 is configured either as a low-bypass turbofan or a high-bypass turbofan, as described above, and the number of spools and fan position vary.

In the particular embodiment of FIG. 1, fan 12 is coupled to LPT shaft 34 via a planetary gear or other fan drive gear mechanism (fan gear) 38 (shown in dashed lines), which provides independent speed control. More specifically, fan gear 38 allows driving the fan 12 at a lower rotational speed than the low pressure spool, increasing the operational control range for improved engine response and efficiency.

In operation of turbofan 10, airflow F enters via inlet 22 and divides into bypass flow $F_B$ and core flow $F_C$ downstream of fan 12. Bypass flow $F_B$ passes through bypass duct 14, generating thrust, and core flow $F_C$ passes along the gas path through compressor 16, combustor(s) 18 and turbine 20.

Compressor 16 compresses incoming air for combustor(s) 18, where it is mixed with fuel and ignited to produce hot combustion gas. The combustion gas exits combustor(s) 18 to enter HPT section 28 of turbine 20, driving HPT shaft 32 and compressor 16. Partially expanded combustion gas transitions from HPT section 28 to LPT section 29, driving fan 12 via LPT shaft 34 and, in some embodiments, fan gear 38. Exhaust gas exits turbofan 10 via exhaust 24.

The thermodynamic efficiency of turbofan 10 is strongly tied to the overall pressure ratio, as defined between the compressed air pressure entering combustor(s) 18 and the delivery pressure at intake 22. In general, higher pressure ratios offer increased efficiency and improved performance, including greater specific thrust, and may result in higher peak gas path temperatures, particularly downstream of combustors(s) 18, including HPT section 28.

Figure 2:
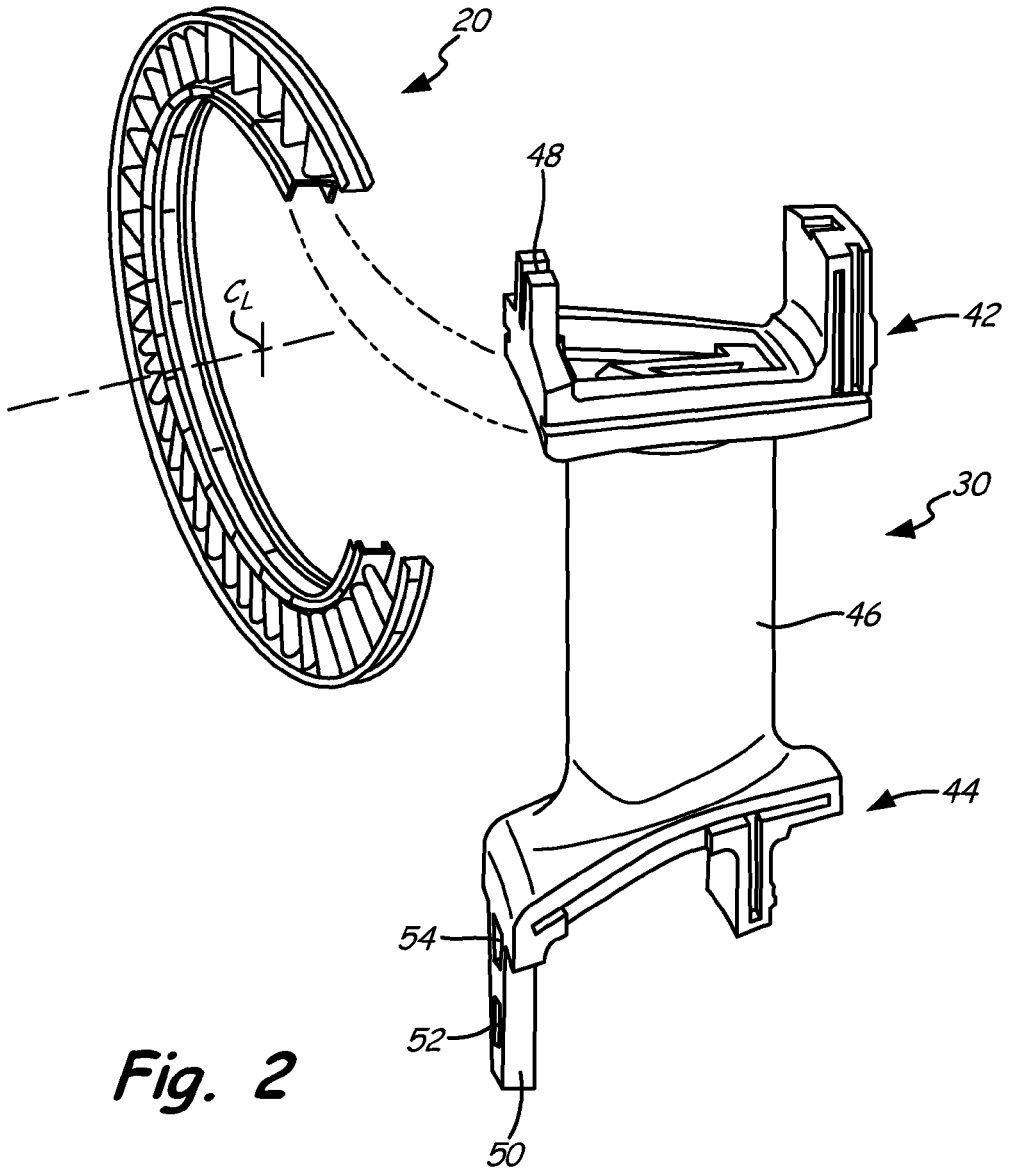
FIG. 2 is an exploded perspective view showing a vane portion of a turbine stage of the gas turbine engine, and one of the turbine vanes that make up the turbine stage.

FIG. 2 is an exploded perspective view showing a portion of turbine stage 20 of gas turbine engine 10, and one turbine vane 30 that makes up turbine stage 20. Like reference numerals identify corresponding or similar elements throughout the several drawings. In FIG. 2, turbine vane 30 includes outer vane platform 42 and an inner vane platform 44 radially spaced apart from each other, and airfoil 46 extended radially between outer vane platform 42 and inner vane platform 44. Placing inner vane platforms 42 and outer vane platforms 44 from adjacent turbine vanes 30 circumferentially against respective inner vane platforms and outer vane platforms allows for collectively forming a full, annular ring about the centerline axis $C_L$ of the engine.

Each turbine vane 30 may include one or more circumferentially spaced airfoils 46 which radially extend between inner vane platform 42 and outer vane platform 44 for directing the flow of gases from the combustor 18 (see FIG. 1) through turbine stage 20. A mounting lug, or tab 50, is attached to inner vane platform and contains mounting aperture 52 and identification aperture 54. Identification aperture 54 may serve several functions, including reducing the weight of turbine vane 30 due to the material removal from tab 50. Additionally, identification aperture 54 may be of a specific geometry for a specific engine model to provide a visual marker on the component that may be used to distinguish turbine vane 30 from other similarly shaped turbine vanes for different engine models. Outer vane platform contains a mounting slot 48, which may be used as a further identification or mistake proofing feature. Inner vane platforms 42 and outer vane platform 44 include various additional components attached thereto which shall be later described.

Figure 3:
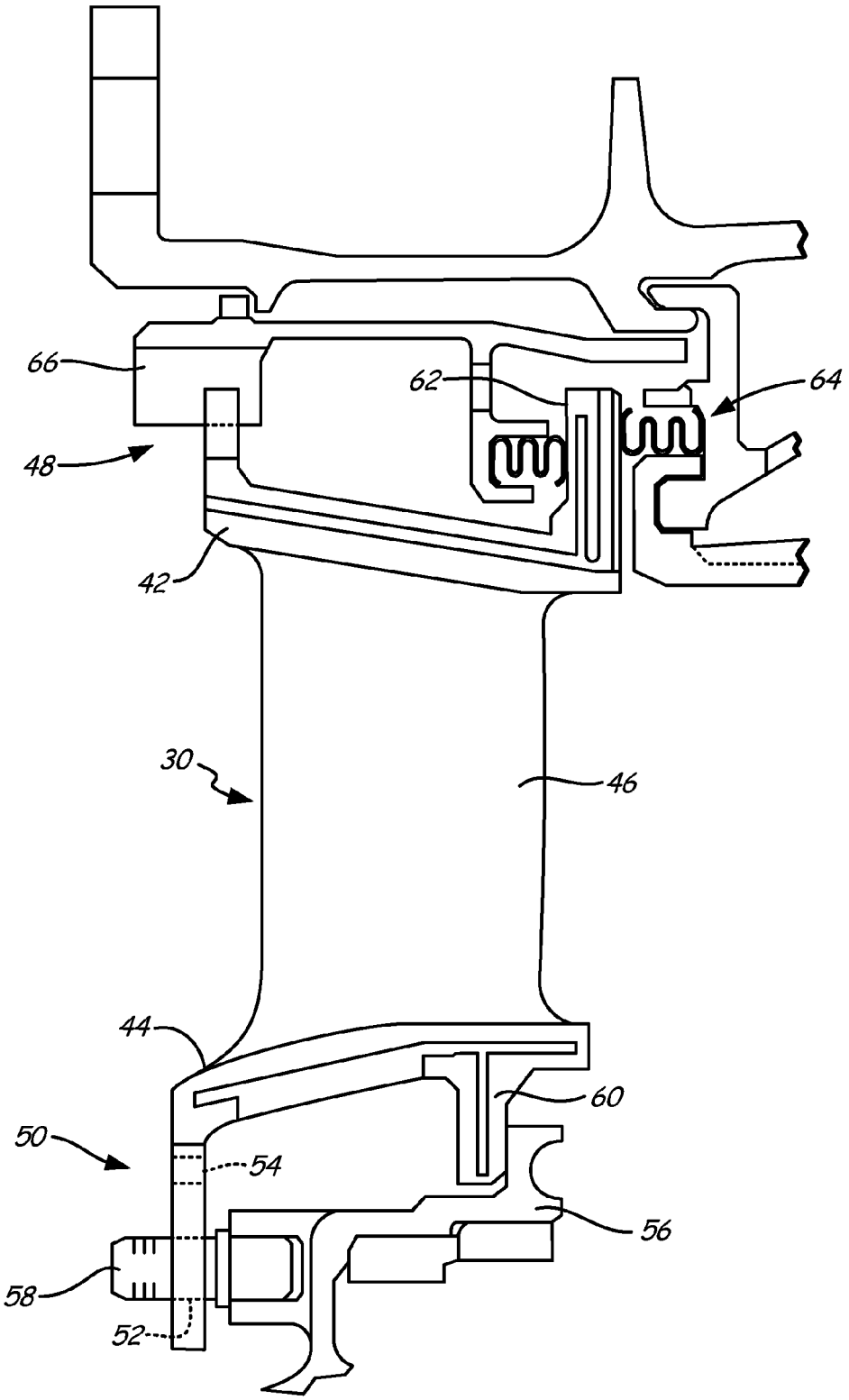
FIG. 3 is a schematic sectional view of a turbine section.

FIG. 3 is a schematic sectional view of turbine vane 30. Outer vane platform 42 may form a portion of outer core engine structure and inner vane platform 44 may form a portion of inner core engine structure to at least partially define the annular turbine stage 20 gas flow path.

Inner vane platform 44 contains tab 50 with mounting aperture 52 and identification aperture 54. Tab 50 is utilized to mount and secure the inner vane platform 44 with respect to the other components of engine 10, such as through a pin 58 from the tangential on-board injector (TOBI) 56 that extends into mounting aperture 52. The opposite end of inner vane platform contains mounting flange 60 that also abuts a portion of TOBI 56.

Outer vane platform 42 includes structural flange 62 which extends in a radial outward direction adjacent the trailing edge of airfoil 46. Structural flange 62 operates as seal surface for forward seal and aft seal assemblies 64. Structural flange 62 may also includes one or more feather seal slots within the mate surface between adjacent outer vane platforms 42 to provide a seal between circumferential adjacent turbine vanes 30.

Turbine vanes 30 also contain mounting slot 48 on outer vane platform 42. Mounting slot may be a fork for receiving tab 66 or a similar structure on a vane support to further secure turbine vane 30, such as acting as an anti-rotation feature.

Figure 4A:
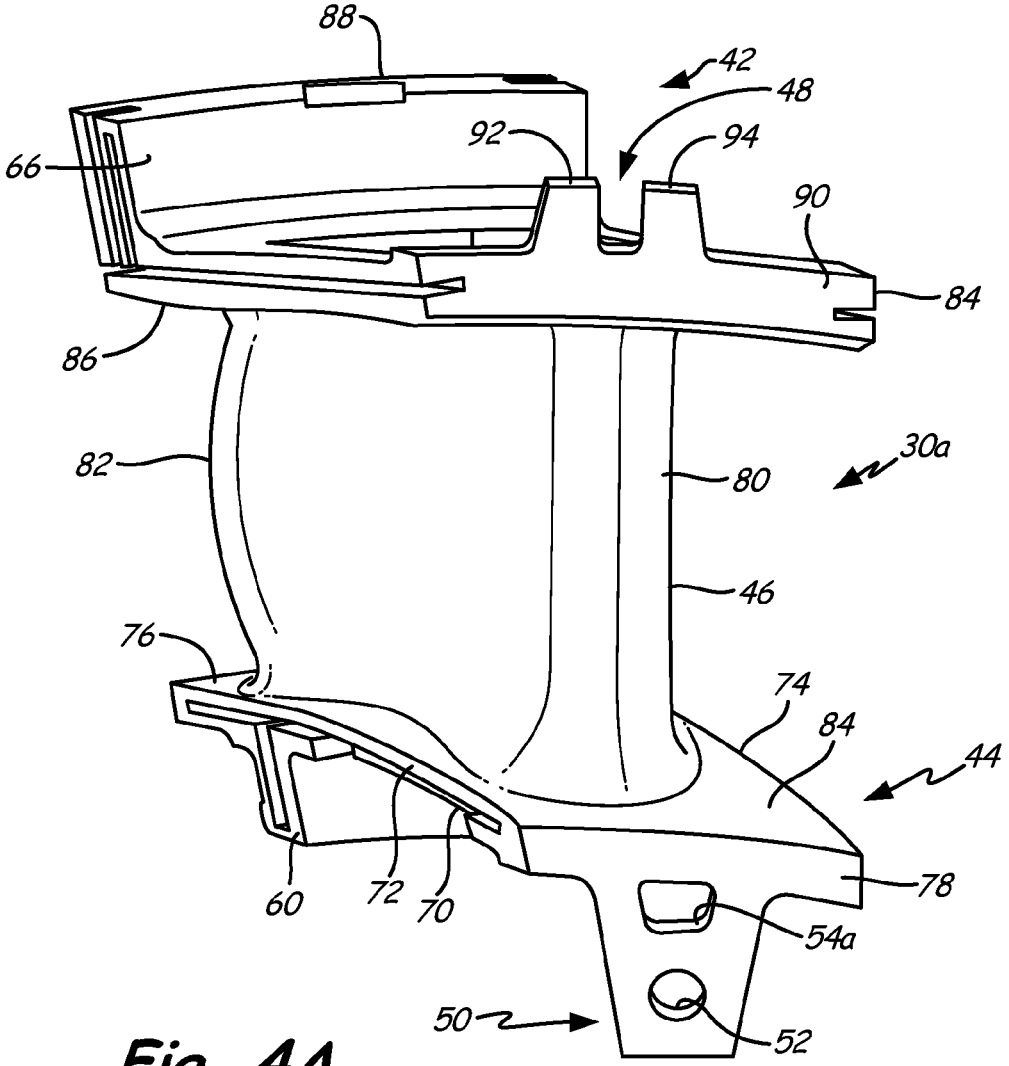
FIG. 4A is a perspective view of a turbine vane for a first engine.
Figure 4B:
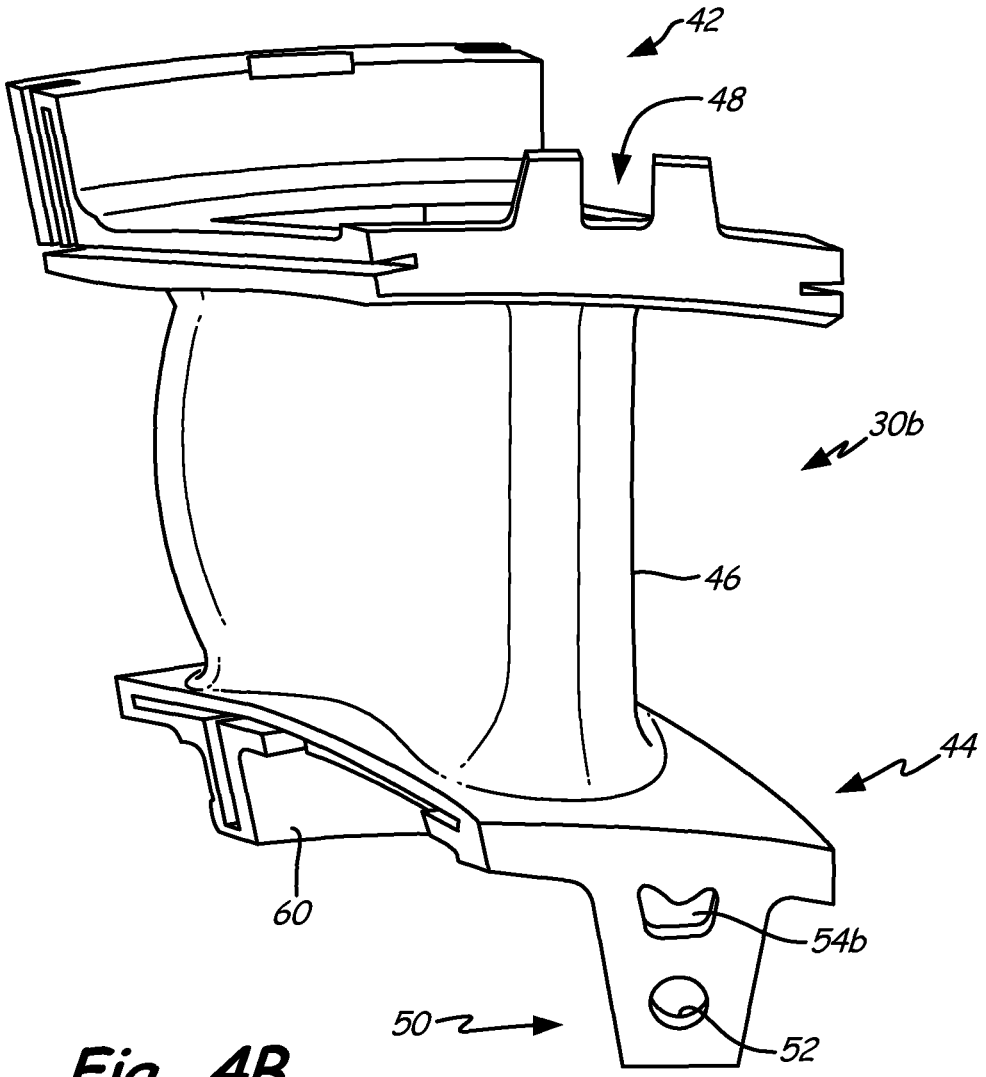
FIG. 4B is a perspective view of a similar turbine vane for a second engine.

FIGS. 4A and 4B are perspective views of turbine vanes 30*a* and 30*b*, which are similar in construction, but are for use in different gas turbine engines. As illustrated in FIG. 4A, turbine vane 30*a* has inner vane platform 44 with first side 72 and second side 74 extend between front side 78 and rear side 76. Airfoil 46 has leading edge 80 and trailing edge 82. Front side 78 is adjacent leading edge 80 of airfoil 46, and rear side 76 is adjacent trailing edge 82 of airfoil 46. Inner vane platform 44 has inner surface 70 and outer surface 84. Mounting flange 60 extends radially inward from inner surface 70 of inner vane platform 44, adjacent trailing edge 82 of airfoil 46 and rear side 76. Tab 50 is a mounting lug located adjacent leading edge 80 of airfoil 46. Turbine vanes 30 are components of engine 10, and have airfoil 46 between outer surface 84 of inner vane platform 44 and inner surface 86 of outer vane platform 42.

Tab 50 also contains identification aperture 54*a*, which may be an identification features of turbine vane 30*a*. In an alternate embodiment, tab 50 will have a different geometry depending on the engine it is to be installed, such as a greater length, different slope for one or more sides to create different angles, or similar features. Similarly, identification aperture 54*a* may be replaced with a series of apertures adjacent one another, or scalloping of the outer edges of tab 50. Identification aperture 54*a* is created by material removal from turbine vane 30*a*, and thus reduces the weight of the component, as well as turbine stage 20 and entire engine 10. Identification apertures 54*a* may be utilized in the manufacturing of turbine vane 30*a*, such as by providing a fixturing point or datum location for positioning turbine vane 30A during machining, coating, or similar fabrication techniques of turbine vane 30. The location of aperture 54*a* is radially outward from mounting aperture 52, and may be located below inner surface 70 of inner vane platform 44.

FIG. 4B contains a similar turbine vane 30*b* with airfoil 46 between inner vane platform 44 containing tab 50 and mounting flange 60, and outer vane platform 42 containing mounting slot 48. Tab 50 contains mounting aperture 52 and identification aperture 54*b*. Turbine vane 30*b* of FIG. 4B is for a different engine than that illustrated in FIG. 4A. Mounting aperture 52 may be of a different diameter. Identification aperture 54*b* contains a different geometry than that illustrated in FIG. 4A. Thus, although turbine vanes 30*a* and 30*b* look similar, a quick visual inspection of the identification aperture 54*a* or 54*b* will indicate the proper engine model into which to install the component.

Identification apertures 54*a* and 54*b* may contain varying features to visually distinguish between turbine vanes 30*a* and 30*b* of FIGS. 4A and 4B. For example, apertures 54*a* and 54*b* may contain differing geometries that are easily identified by visual inspection, and do not require measurement of the component to determine in which engine the component will fit. For example, the turbine vane of one model of engine may contain a square aperture, and the turbine vane of another model may contain an oval identification aperture. As illustrated, turbine vane 30*a* of FIG. 4A contains a generally rectangular identification aperture 54*a*, while turbine vane 30*b* of FIG. 4B has identification aperture 54*b* with a trapezoidal cross section with a bump extending from the longest parallel side of the trapezoid. Having aperture cut-outs of different shapes/sizes for apertures 54*a* and 54*b* for each specific engine vane provides a visual mistake reducing feature to prevent vanes from being inserted in the wrong location. These differing cut-outs may be created by differing tooling. In the past, turbine vanes would simply labeled, which required a close inspection. With the current differing geometries of apertures 54*a* and 54*b* on turbine vanes 30*a* and 30*b* for different engine models, a quick visual inspection of the part is all that is required, and not a reading of a part number or similar small and extensive text. That is, each engine model with similarly shaped turbine vanes will each be provided with a different, easily identifiable geometry for the identification aperture. The proximity of the identification feature to the mounting aperture assists in the quick visual identification of the component during installation as an installer will already be looking at the mounting aperture to affix the turbine vane in the engine. The identification features described may be applicable to other assemblies, such as vane doublets.

With the above disclosed structure, a turbine vane for engine may be designed to provide mistake reductions during assembly. The engine includes a component, such as turbine vane 30, with an identification feature, such as aperture 54*a* or 54*b*. The component is manufactured with the identification feature adjacent the mounting aperture. The engine design instructions are provided during assembly of the engine so that the identification feature on the engine component is visually compared to the engine design instructions to assure the component is being installed in the correct engine. Although turbine vanes 30 for a turbine stage are illustrated in the disclosed embodiment, it should be understood that other sections of engine 10, such as compressor nozzle sections, may also benefit herefrom.

Discussion of Possible Embodiments

The following are non-exclusive descriptions of possible embodiments of the present invention.

A turbine vane for a gas turbine engine has a turbine vane for a gas turbine engine has an inner platform, an outer platform, at least one airfoil extending between the inner and outer platforms, and a tab radially extending inward from a front side of the inner platform. The tab contains a mounting aperture and an identification aperture that identifies an engine in which the turbine vane may be installed.

The turbine vane of the preceding paragraph can optionally include, additionally and/or alternatively, any one or more of the following features, configurations and/or additional components:

the identification aperture is generally trapezoidal;

the identification aperture is radially outward from the mounting aperture on the tab;

the identification aperture is located radially inward from an inner surface of the inner platform; and/or the inner platform includes a mounting flange adjacent a rear side of the inner platform.

A method includes designing an engine including a component with an identification feature that identifies the engine, providing the component with the identification feature, and providing the engine design instructions during assembly of the engine so that the identification feature on the engine component is visually compared to the engine design instructions to assure the component is being installed in the correct engine.

The method of the preceding paragraph can optionally include, additionally and/or alternatively any one or more of the following features, configurations, steps, and/or additional components:

the component is turbine vane;

the identification feature is located on an inner platform of the turbine vane;

the identification feature is located on a mounting lug radially extending from the inner platform;

the identification feature is an aperture;

the inner platform contains a mounting flange;

the aperture is trapezoidal in shape;

the mounting lug includes a mounting aperture; and/or the mounting aperture is radially inward from the identification feature.

A method of producing a turbine vane includes producing a turbine vane with a tab radially extending inward from a front side of an inner platform of the vane, and producing a visually identifiable feature on the tab that identifies the engine in which the turbine vane may be installed.

The method of the preceding paragraph can optionally include, additionally and/or alternatively any one or more of the following features, configurations, steps, and/or additional components:

the visually identifiable feature is an aperture;

the aperture is trapezoidal in shape;

the tab further includes a mounting aperture;

the mounting aperture is radially inward from the visually identifiable feature; and/or the inner platform includes a mounting flange extending radially inward adjacent a rear side of the inner platform.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A method comprising:

producing a first turbine vane including:

a first inner platform;

a first outer platform;

at least one first airfoil extending between the first inner and first outer platforms; and a first tab extending radially inward from a front side of the first inner platform;

producing a first visually identifiable feature on the first tab that identifies a first engine in which the first turbine vane may be installed, wherein the first visually identifiable feature is a first aperture extending fully through the first tab;

producing a second turbine vane including:

a second inner platform;

a second outer platform;

at least one second airfoil extending between the second inner and second outer platforms; and a second tab extending radially inward from a front side of the second inner platform producing a second visually identifiable feature on the second tab that identifies a second engine in which the second turbine vane may be installed, wherein the second visually identifiable feature is visually distinct from the first visually identifiable feature, and wherein the second visually identifiable feature is a second aperture extending fully through the second tab; and identifying the first turbine vane by visually comparing the first visually identifiable feature with the second visually identifiable feature;

installing the first turbine vane in the first engine.

2. The method of claim 1, wherein the first tab further includes a first mounting aperture.

3. The method of claim 2, wherein the first mounting aperture is radially inward from the first visually identifiable feature.

4. The method of claim 1, wherein the first inner platform includes a first mounting flange extending radially inward adjacent a rear side of the first inner platform, and the second inner platform includes a second mounting flange extending radially inward adjacent a rear side of the second inner platform.

5. The method of claim 1, wherein the first aperture has a first geometry and the second aperture has a second geometry, the first geometry being different than the second geometry.

6. The method of claim 5, wherein the first aperture is trapezoidal in shape and the second aperture is trapezoidal in shape with a bump extending into the second aperture from a longest parallel side of the trapezoid.

7. The method of claim 1, wherein the second tab further includes a second mounting aperture.

8. The method of claim 7, wherein the second mounting aperture is radially inward from the second visually identifiable feature.

9. The method of claim 1, wherein the first turbine vane is a scaled representation of the second turbine vane.

* * * * *